United States Patent [19]

Taylor et al.

[11] Patent Number: 4,905,717

[45] Date of Patent: Mar. 6, 1990

[54] COMB WITH BUILT-IN LEVEL ADJUSTABLE TO A PLURALITY OF ORIENTATIONS

[76] Inventors: Jonathan Taylor, 619 Lindley Rd., Glenside, Pa. 19138; Francis Bellofatto, 6 Ticonderoga, Laurel Springs, N.J. 08021

[21] Appl. No.: 338,034

[22] Filed: Apr. 14, 1989

[51] Int. Cl.[4] ..... A45D 24/00

[52] U.S. Cl. ..... 132/148; 132/219

[58] Field of Search ..... 132/119, 148; 15/105; 33/383, 384, 385, 386, 387, 388

[56] References Cited

U.S. PATENT DOCUMENTS

| | | | |
|---|---|---|---|
| 2,786,477 | 3/1957 | Cohen | 132/214 |
| 2,879,777 | 3/1959 | Miller | 132/148 |
| 4,517,998 | 5/1985 | Furco | 132/148 |

*Primary Examiner*—Gene Mancene
*Assistant Examiner*—Michael Lynch
*Attorney, Agent, or Firm*—Louis Weinstein

[57] ABSTRACT

A comb comprised of an elongated back having integral substantially parallel teeth extending therefrom. A bubble-type level is rotatably mounted within a first recess provided in the comb back. The level is mounted to rotate about its longitudinal axis and is provided with a plurality of projections spaced at predetermined angular intervals arranged along one end of the level for cooperation with a second recess to form a "click-lock" arrangement with the second recess provided in a cooperating sidewall of the first recess to automatically lock the level into the desired orientation which may, for example, be right-lock, center-lock or left-lock orientations. The level facilitates leveling of the comb during use.

17 Claims, 4 Drawing Sheets

COMB WITH BUILT-IN LEVEL ADJUSTABLE TO A PLURALITY OF ORIENTATIONS

FIELD OF THE INVENTION

The present invention relates to combs and more particularly to combs provided with a level which is rotatably adjustable about its longitudinal axis to accommodate a leveling operation for various orientations of the comb which are encountered during normal use.

BACKGROUND OF THE INVENTION

Individuals as well as hair salons typically utilize combs in conjunction with scissors or other cutting instruments when cutting hair. It is frequently desirable to orient the comb so that it is level or parallel with the horizontal to facilitate a cutting operation. The accuracy of the orientation is typically limited to the operator's judgment. It is thus desirable to provide an instrument, such as a level, to obtain much greater accuracy in alignment of the comb. Although it is known in the art to mount a level upon a hair cutting guide, it is still nevertheless desirable to provide a level which is capable of assuming a variety of different orientations in order to accommodate a variety of orientations of the comb which is typically encountered during normal use and further to facilitate rapid and simple adjustment of the level.

BRIEF DESCRIPTION OF THE INVENTION

It is, therefore, one object of the present invention to provide a comb which is capable of being easily and rapidly oriented and maintained in the desired position by means of a rotatable mounted level further incorporating click stop detent means for automatically orienting the level in the desired position to accommodate orientations of the comb typically encountered during normal use.

The present invention is comprised of a comb having a substantially conventional back with a plurality of integral parallel teeth extending therefrom. The portion of the back remote from said teeth is provided with a recess for receiving a level having a substantially cylindrical shape. The level, in one embodiment, may be provided with spindle receiving openings at opposite ends thereof, each opening adapted to receive a spindle provided at opposite sidewalls of the recess provided in the comb back. A helical spring is provided about one of the spindles for biassing the level towards the opposite spindle which is provided with a recess for cooperating with one of a plurality of projections or teats arranged at spaced intervals about the adjacent end surface of the level whereby, upon alignment of said recess with one of said teats, the level snaps into a detent position thereby maintaining the level in a predetermined, desired orientation to facilitate positioning of the comb during use. In the preferred embodiment, the comb may be arranged, for example, so that it is oriented with the vertical direction; oriented with the horizontal direction with one side of the comb facing upwardly and oriented in the horizontal direction with the opposition side of the comb facing upwardly to facilitate reading of the level. Rotation of the level to the desired orientation greatly facilitates the observation of the level to orient the comb.

OBJECTION OF THE INVENTION AND BRIEF DESCRIPTION OF THE FIGURES

It is, therefore, one object of the present invention is provide a comb having a level which is capable of being rotated to a variety of orientations.

Still another object of the present invention is to provide a comb having a level which is rotated about its longitudinal axis to facilitate use of the level for orienting the comb in a variety of different positions.

Still another object of the present invention is to provide a comb provided with a level which is rotatable about its longitudinal axis and including detent means for automatically locking the level into any one of a plurality of orientations.

The above as well as other objects of the present invention will become apparent when reading the accompanying description and drawing, in which:

FIG. 1 shows a combined comb and level structure embodying the principles of the present invention.

FIGS. 2*a* through 2*i* show a number of different embodiments for mounting the level to the comb.

FIG. 3*a* shows a top view of a portion of FIG. 1 looking in the direction of arrows 3—3.

FIG. 3*b* shows an end view of a portion of the comb of FIG. 1 looking in the direction of arrows 3*b*—3*b*.

FIG. 4 shows another embodiment of the combined comb and level.

DETAILED DESCRIPTION OF THE INVENTION AND ITS PREFERRED EMBODIMENTS

Figure 1:
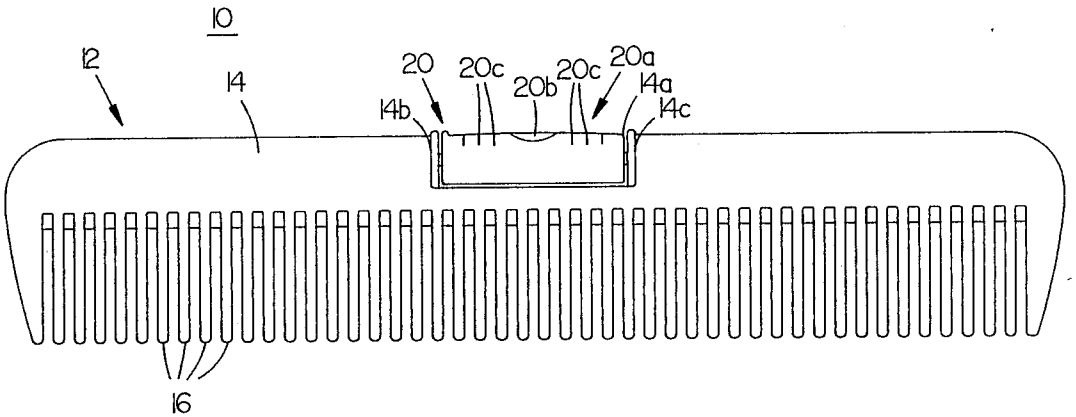

FIG. 1 shows a combined comb and level assembly 10 embodying the principles of the present invention. The assembly 10 is comprised of a comb 12 of generally conventional type and having a back 14 and a plurality of integral, substantially parallel teeth extending from the lower end of back 14. Back 14 is provided with an elongated recess 14*a*. A level 20 is rotatably mounted within recess 14*a* so as to be rotatable about its longitudinal axis.

Level 20 may be a liquid level type indicator which is well known to the art and which is preferably transparent along at least its upper surface 2*a* to render bubble 20*b* visible therethrough. The bubble freely moves along the cylindrical housing, settling at a location according to the orientation of the housing. Graduations 20*c* facilitate determination of when the bubble 20*b* is properly centered to indicate a level condition.

As was mentioned hereinabove, level 20 is rotatable about its longitudinal axis represented, for example, by chain line 21 shown in FIG. 2*b*, in order to rotate the level to any one of a plurality of different orientations to facilitate observation of the bubble through the transparent portion of the housing.

Figure 2A:
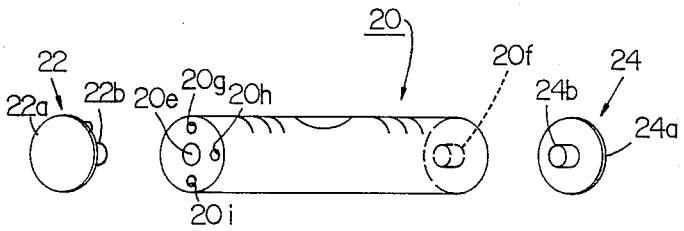
Figure 2B:
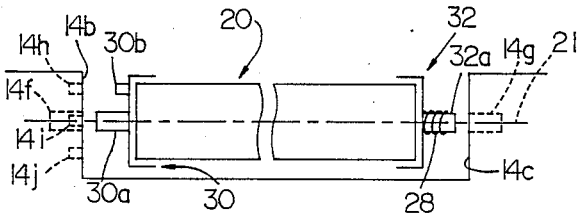

One mounting arrangement is shown in FIG. 2*a* wherein level 20, which is a substantially cylindrical-shaped body, is provided with openings 20*e* and 20*f* at its left-hand and right-hand ends. Spindles 22 and 24 are arranged at the sidewalls 14*b*, 14*c* (see FIG. 1) of recess 14*a*. The spindles may, for example, be plates 22*a*, 24*a* each provided with a projection or spindle 22*b*, 24*b* arranged to extend into openings 20*e*, 20*f* respectively, for rotatably mounting level 20.

Figure 2C:
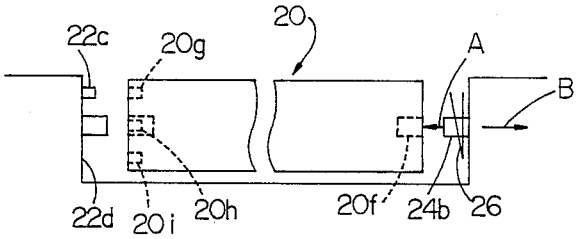
Figure 3B:
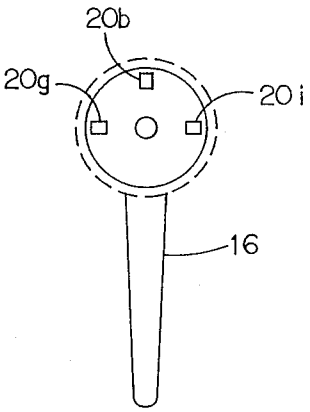
Figure 3A:
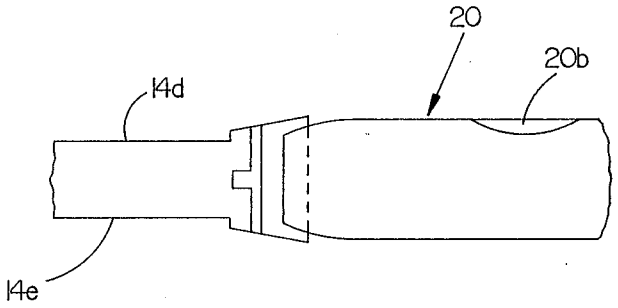

A flexible spring element such as a spring 26 is provided on spindle 24*b* as shown in FIG. 2*c* in order to bias level 20 in the direction shown by arrow A. The V-shaped spring 26 facilitates the click-stop arrangement which, in the embodiment shown in FIGS. 2*a* and 2*c*, comprised of a projection 22*c* which cooperates with one of the recesses 20*g*, 20*h*, and 20*i* arranged along the left hand side of level 20. The manner in which the click stop arrangement operates is as follows:

In order to change the angular orientation of level 20, the level is gripped between the fingers and moved in a direction shown by arrow B to move level 20 and hence recesses 20*g*–20*i* away from projection 22*c*. As soon as the recess receiving projection 22*c* is clear of the projection, the level is free to be rotated about its longitudinal axis. After rotation through a small angle, the force urging the level 20 in the direction of arrow B may be released causing spring 26 to urge level 20 in the direction shown by arrow A, whereupon projection 22*c* will slide along the surface of the left-hand end of level 20 whereupon level 20 may be further rotated until the projection 22*c* moves into alignment with one of the recesses 20*g*–20*i*, at which time spring 26 causes the level to snap into a detent position in a click-lock fashion. As shown in FIG. 3*b*, the recesses 20*g*–20*i* may be arranged so that they respectively orient the level in a "right lock", "center lock" and "left lock" position. For example, FIG. 1 shows the level in the center lock position wherein the comb is substantially aligned with the vertical direction and the transparent reading portion of the level extends directly upward. Moving the comb so that it lies in a substantially horizontal plane, the level is rotated so that one of the right-lock or left-lock detent recesses is selected, whereupon the level is oriented with one of the associated side surfaces 14*d* or 14*e* of comb 12 as shown, for example, in FIG. 3*a*.

Although three detent positions have been shown for three possible orientations, a greater or lesser number of detent arrangements may be provided.

Figure 2D:
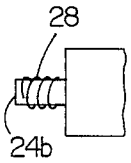
Figure 2E:
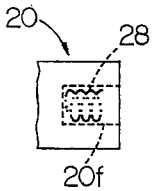

The V-shaped resilient spring 26 shown in FIG. 2*c* may be replaced by a helical spring 28 shown in FIG. 2*d*. Helical spring 28 may placed about spindle 24*b* or, alternatively, as shown in FIG. 2*e*, spring 28 may be positioned within recess 20*f* of level 20.

As a further alternative, the spindles 22 and 24 mounted at the left-hand and right-hand sides 14*b* and 14*c* of recess 14*a* may be eliminated and replaced by spindles 30 and 32 having end cap portions which are fixedly secured to the left-hand and right-hand ends of level 20 by a suitable glue or epoxy. Spindles 30*a*, 32*a* are arranged to extend into openings 14*f*, 14*g* provided in sidewalls 14*d*, 14*c* respectively.

In the embodiment of FIG. 2, the detent projection 30*b* is provided on end cap 30 and is arranged to cooperate with a plurality of recesses 14*h*, 14*i*, 14*j* arranged in sidewall 14*b*. A helical spring 28 is utilized to normally urge level 20 and hence projection 30*b* into engagement with one of the detent recesses 14*h*–14*j*. Alternatively, helical spring 28 may be mounted within opening 14*g* or may be omitted and replaced by flexible spring 26.

Figure 2F:
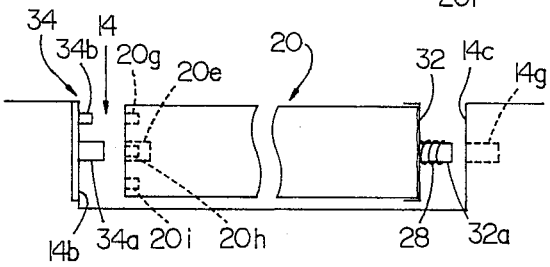

FIG. 2*f* shows still another embodiment of the present invention in which end cap 32 is secured to the right-hand end of level 20 while the left-hand end of level 20 is provided with an opening 20*e*. Recess 14*g* is provided in right sidewall 14*c* to cooperate with spindle 32*a* which receives helical spring 28.

A spindle member 34 is mounted to the left-hand sidewall of 14*b* of recess 14 and is received within opening 20*e* in the left-hand end of level 20. Detent recesses 20*g*–20*i* are provided in the left-hand end of level 20 for cooperation with detent projection 34*b* integral with and extending from spindle member 34.

Any of the above embodiments may be utilized with equal success to provide a rotatably mounted level which further includes detent means for automatically locking the level into any one of a plurality of desired orientations. Recess 14*a*, in addition to providing a suitable notch for the mounting of the level, further facilitates observation of the transparent portion of the level regardless of whether the transparent portion is in the "12 o'clock", "3 o'clock" or "9 o'clock" position determined by the recesses 20*h*, 20*i* and 20*g* respectively shown, for example, in FIG. 3*b*.

The level and detent assembly may be simply and readily mounted in position within recess 14, for example, in the following manner:

Noting the embodiment of FIG. 2*c*, the spindles 22, 24 may be inserted within the respective openings 20*e*, 20*f* in level 20, with spring 26 mounted in the position as shown. An epoxy or other suitable glue is applied to end surfaces 14*b* and 14*c* of recess 14*a* and the assembly as shown in FIG. 2*c* is positioned between said recesses with the spindle members 22 and 24 pressing against the epoxy applied to sidewalls 14*b*, 14*c*. Spring 26 serves to exert sufficient outward forces to urge the spindle members 22 and 24 into firm engagement with the epoxy which, upon setting, completes the assembly. The assembly is preferably oriented such that the detent projection is extended into one of the detent recesses in order to properly align the level relative to the comb body.

Figure 4:
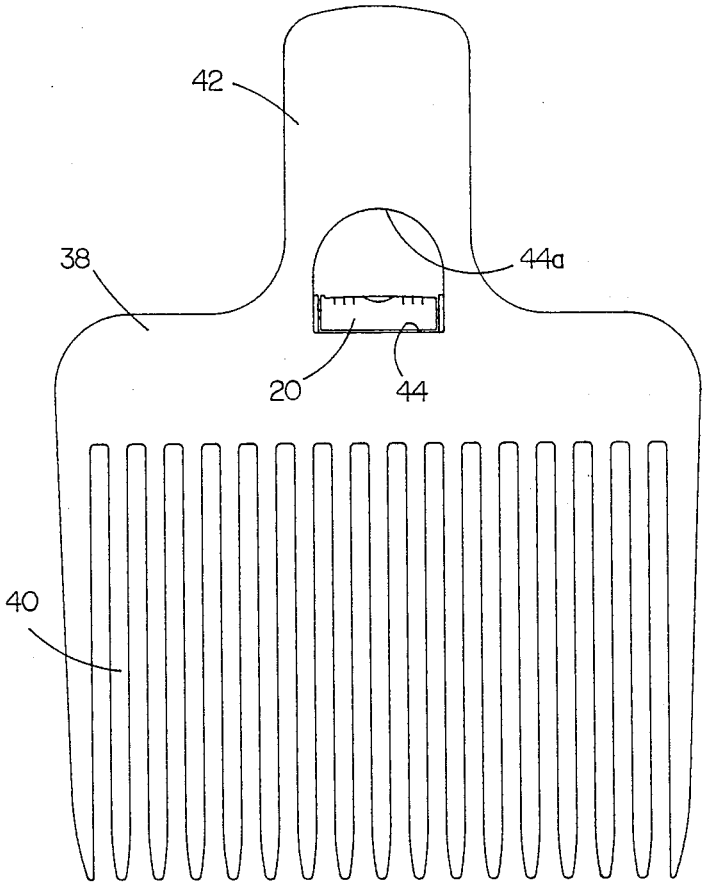

The principles of the present invention may be embodied in combs of other sizes and figurations. For example, FIG. 4 shows a comb which is typically referred to as a hair cutting guide having a body 38 provided with downwardly depending integral teeth 40 and a handle 42 extending in a direction opposite that of teeth 40. A recess 44 is provided for receiving level 20. A portion 44*a* of recess 44 is cut away to facilitate observation of level 20 when oriented in the vertical direction, in addition to be easily readable when oriented in the horizontal direction with either side surface of the hair cutting guide extending upwardly. Level 20 is positionable in a detent-like fashion by providing one of the mounting and detent assemblies shown in FIGS. 2*a* through 2*f*.

Figure 2G:
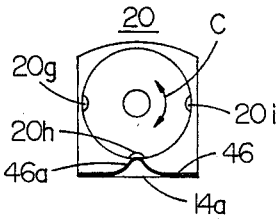

FIG. 2*g* shows still another alternative embodiment of the present invention in which the detent mechanism is comprised of a substantially U-shaped detent spring 46 secured to the base of recess 14*a* and having a detent projection portion 46*a* extending into one of a plurality of detent recesses 20*g*, 20*h* and 20*i* arranged adjacent the cylindrical surface of the level 20. As the level 20 is rotated about its longitudinal axis in either the clockwise or counter-clockwise direction, as shown by double-headed arrow C, detent spring 46 is caused to flex, for example, moving out of recess 20*h* and, depending upon the direction of rotation, moving into either recess 20*g* or 20*i*.

Figure 2H:
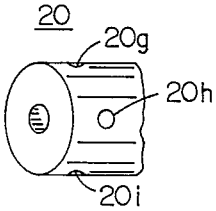

The recesses 20*g*–20*i* may be provided at one end face of the level as shown in FIG. 2*g* or may be provided along the cylindrical surface of level 20 at a location intermediate the left-hand and right-hand ends of level 20 as shown in FIG. 2*h*.

Figure 2I:
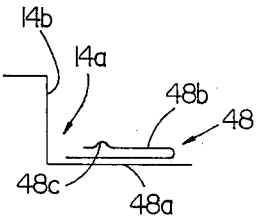

The U-shaped resilient detent spring 46 may be replaced by a substantially V-shaped leaf spring 48 shown in FIG. 2*i* whose lower arm is secured to the base of the recess 14*a* by a suitable epoxy and whose remaining arm 48*b* is provided with a detent projection 48*c* for insertion into one of the detent openings 20*g*–20*i*. The spring 48 may be located within the recess so as to cooperate with the detent recesses arranged at one end face of the level 20 as shown in FIG. 2*g* or so as to cooperate with detent recesses provided along the surface of the level 20 at a location intermediate the ends of the level, as shown, for example, in FIG. 2*h*.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention described herein.

What is claimed:

1. A comb-like member for use in cutting hair comprising:

an elongated back having a plurality of integral teeth extending therefrom and being substantially arranged in spaced parallel fashion;

said back having a recess extending into one edge of said back remote from said teeth;

a level arranged within said recess, the longitudinal axis of said level being substantially perpendicular to said teeth;

and means for rotatably mounting said level within said recess to permit said level to be oriented at any desired angle by rotation about its longitudinal axis, said recess facilitating the viewing of said level at a plurality of orientations to facilitate orientation of said comb-like member and viewing of said level.

2. The apparatus of claim 1 wherein said level comprises a hollow body containing an observable element movable in said housing responsive to the orientation of said level;

said body having a transparent surface portion for observing the observable element therethrough.

3. The apparatus of claim 2 wherein said observable element comprises a bubble within the liquid contained in said housing.

4. The apparatus of the claim 1 wherein said transparent surface is provided with indicia cooperating with said observable element to facilitate reading of said level.

5. The apparatus of claim 1 wherein said means for rotatably mounting said level comprises spindle means arranged in said recess cooperating with openings in opposite ends of said level.

6. The apparatus of claim 1 wherein said means for rotatably mounting said level comprises spindle means mounted on the ends of said level cooperating with openings provided in the sidewalls of said recess.

7. The apparatus of claim 1 further comprising detent means for automatically orienting said level in any one of a plurality of detent positions.

8. The apparatus of claim 7 wherein said detent means comprises a projection along one of said side walls cooperating with a plurality of detent recesses provided along one end surface of said level.

9. The apparatus of claim 8 wherein at least three detent recesses are provided.

10. The apparatus of claim 8 further comprising resilient spring means mounted between the end of said level in the sidewall of said recess remote from said detent means for normally urging the detent projection towards said detent recesses.

11. The apparatus of claim 10 wherein said resilient bias means is a V-shaped leaf spring.

12. The apparatus of claim 10 wherein said resilient bias means is a helical spring.

13. The apparatus of claim 8 wherein said detent means comprises a plurality of detent recesses provided at spaced intervals about the body of said level;

resilient means arranged along the base of the recess in the comb body and having a free end thereof forming a detent projection insertable into one of said detent recesses for releasably locking said level in a selected one of the detent positions.

14. The apparatus of claim 13 wherein said detent spring comprises a substantially V-shaped leaf spring.

15. The apparatus of claim 13 wherein said detent leaf spring comprises a substantially U-shaped leaf spring.

16. The apparatus of claim 7 wherein said detent means comprises a projection along the end surface of said level and the detent recesses are provided along one sidewall of said recess in the comb body.

17. The apparatus of claim 16 wherein at least three detent recesses are provided.

* * * * *